US006561196B2

(12) United States Patent
Gamburg

(10) Patent No.: US 6,561,196 B2
(45) Date of Patent: May 13, 2003

(54) PHOTO NAILS AND METHOD OF APPLICATION

(75) Inventor: Stanford R. Gamburg, Las Vegas, NV (US)

(73) Assignee: Four Star Productions, L.L.C., Las Vegas, NV (US)

( * ) Notice: Subject to any disclaimer, the term of this patent is extended or adjusted under 35 U.S.C. 154(b) by 0 days.

(21) Appl. No.: 09/915,945

(22) Filed: Jul. 25, 2001

(65) Prior Publication Data

US 2002/0014248 A1 Feb. 7, 2002

Related U.S. Application Data

(60) Provisional application No. 60/221,298, filed on Jul. 27, 2000.

(51) Int. Cl.[7] ..... A45D 29/00; A45D 29/18

(52) U.S. Cl. ..... 132/73; 132/73.5

(58) Field of Search ..... 132/73, 73.5; 434/100; 700/161; D28/56, 57, 59, 62; D8/14, 16; 81/9.2

(56) References Cited

U.S. PATENT DOCUMENTS

| | | | | |
|---|---|---|---|---|
| 1,889,484 A | | 11/1932 | Marshburn | |
| 3,898,357 A | | 8/1975 | Miller et al. | |
| 4,824,702 A | * | 4/1989 | Straub | 428/15 |
| 4,974,610 A | | 12/1990 | Orsini | |
| 5,316,026 A | | 5/1994 | Jenkins | |
| 5,873,375 A | | 2/1999 | Johnson et al. | |
| 6,026,377 A | | 2/2000 | Burke | |
| 6,065,969 A | * | 5/2000 | Rifkin et al. | 434/100 |
| 6,125,352 A | | 9/2000 | Franklin et al. | |
| 6,157,865 A | * | 12/2000 | Cromett | 700/95 |
| 6,233,682 B1 | | 5/2001 | Fritsch | |
| 6,286,139 B1 | | 9/2001 | Decinque | |

* cited by examiner

*Primary Examiner*—John J. Wilson
*Assistant Examiner*—Robyn Kieu Doan
(74) *Attorney, Agent, or Firm*—R. Richard Costello; Quirk & Tratos

(57) ABSTRACT

A method of placing photographs, pictures, or lithographs on fingernails. The nail is measured, the picture is scanned into a computer, resized to fit the selected nail size and the image is printed. A substrate is applied to the film side of the printed paper sealing the ink and providing a colored backing. Then, a second coating is added which shields the image from damage during processing. The film is separated from the paper backing. A sealant is applied to the film on the opposite side of the image, followed by a covering that guards against wear when the picture is placed on the user's nail. The image is then punched out and an adhesive is applied to the original (printed) side. Finally, the product's adhesive side is applied to the fingernail, followed by at least one coat of clear nail polish that further secures the image to the nail.

33 Claims, 3 Drawing Sheets

PHOTO NAILS AND METHOD OF APPLICATION

CROSS REFERENCE TO RELATED APPLICATIONS

This application claims the benefit of U.S. Provisional Application No. 60/221,298, filed Jul. 27, 2000.

FIELD OF THE INVENTION

The present invention relates to decorating fingernails. Specifically, the present invention is a process of placing photographs, pictures, or lithographs on fingernails and toenails.

BACKGROUND OF THE INVENTION

Women have long used artificial designs and ornaments to decorate their nails. However, such designs are usually only simple patterns or shapes because of the complexity of creating decorations for such a small size (i.e. fingernail size). Another particular problem is that the designs generally need to be applied to artificial nails.

One drawback to nail decorations is that they are usually only comprised of simple shapes and patterns. This is because forming small, detailed areas the size of a fingernail is difficult. Painting the designs by hand requires considerable skill and precision. Masking tape and stencils yield only large, straight-edged patterns. And, silk-screening techniques, as described in U.S. Pat. No. 5,316,026, are not only expensive, but they can only be used to create designs in the center portion of the fingernail.

Another drawback to having only simple shapes and patterns for nail ornamentations is that people can not as readily express themselves. Where basic nail designs such as stripes, clouds, stars, or diamonds Oust to name a few) may be eye-catching and artful, they are not nearly as personalized as a photograph. By applying an actual photo to their nails, people would be able to display something unique about themselves. They could have pictures of their family, friends, pets, vacation, special moments such as graduations or weddings, or even their favorite celebrity. The possibilities are endless. Essentially, it would be just like carrying a wallet full of photos, but a lot "handier" since they are simply on one's nails.

A further drawback to nail designs is that they generally have to be applied to artificial nails. Unfortunately, artificial nails are thick, expensive to purchase, and are not natural looking. They are also inconvenient as they require special maintenance, usually only available at a salon by a professional manicurist. Further, because they adhere directly to one's nails, they damage the natural nail underneath. Not only do they strip the nail into layers when removed, but they can cause medical problems (such as fungus) if worn too long or improperly maintained.

Thus, it can be seen that there is a need in the art for a process of placing decorative photographs on fingernails without the use of artificial nails.

SUMMARY OF THE INVENTION

The user supplies an image and indicates the portion that is desired to be applied to the nail. The user's nail is measured with a template having a plurality of openings of different shapes and sizes, each of which is identified by a number. The picture that is to be applied to the nail is scanned and the image is digitally resized to fit the selected template size. The new image is then printed out on a transparent sheet. In an optional embodiment it is waterside photocopier paper which is comprised of film with a paper backing.

Next, a protective substrate is applied to the film side of the printed paper, sealing the ink and providing a colored backing to the image. Then, coating is added which shields the image from damage during further processing. The paper is submerged in water whereby the film separates from the paper backing. A sealant is applied to the film on the opposite side of the image, followed by a protective covering that guards against wear when the picture is finally placed on the user's nail. The image is then punched out and an adhesive backing is applied to the original (printed) side. Finally, the product's adhesive side is applied to the fingernail, followed by one or more coats of clear nail polish which act to further secure the image to the nail.

It is an object of the present invention to enable users to place decorative photographs, pictures, or lithographs on their fingernails. It is a further object of the present invention to enable users to apply such designs directly on their own, natural nails without the need for artificial nails. Although, they may be placed on artificial nails if the user prefers.

BRIEF DESCRIPTION OF THE DRAWINGS

Details of the present invention will be further understood upon reference to the drawing, wherein.

DETAILED DESCRIPTION

Figure 1:
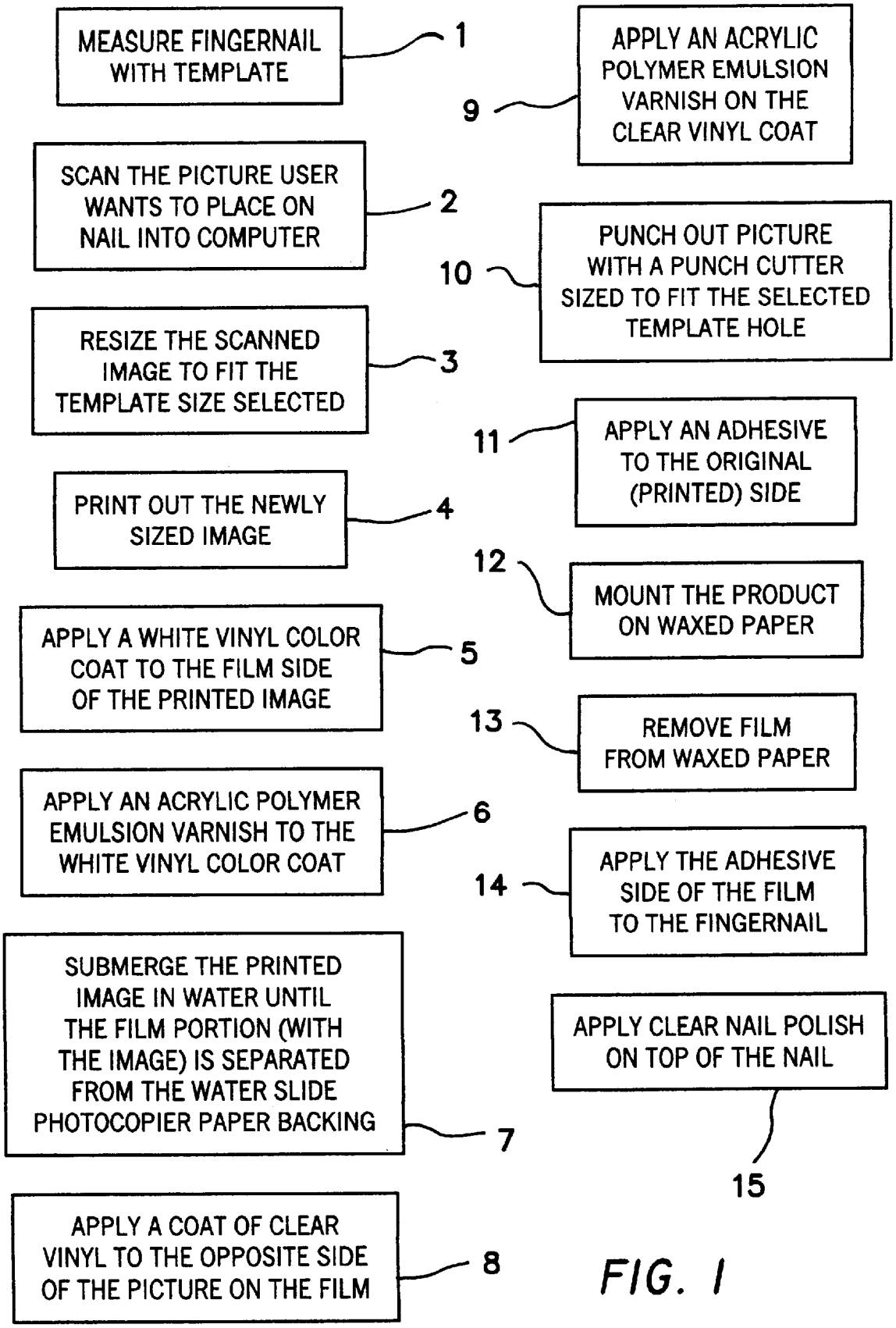
FIG. 1 is a flow diagram of the entire method of a preferred embodiment of the present invention.

Reference is now made to the figures wherein like parts are referred to by like numerals throughout. FIG. 1 is a flow diagram outlining a preferred embodiment of the entire process of applying pictures to fingernails.

Figure 2:
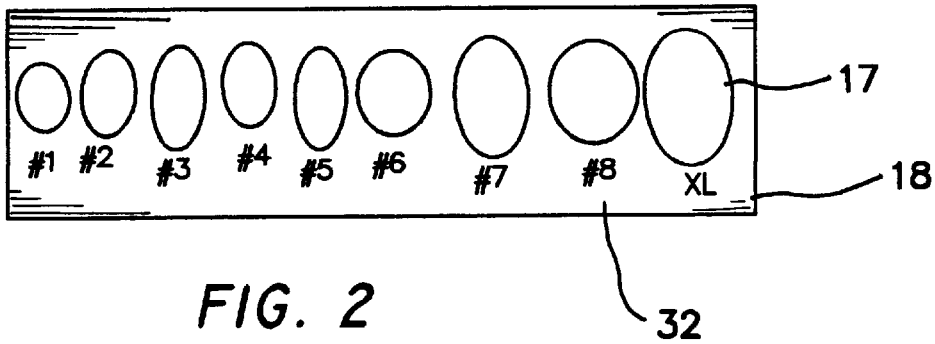
FIG. 2 is a top view of the nail template having a plurality of openings with different shapes and sizes, each of which is identified by a number.
Figure 3:
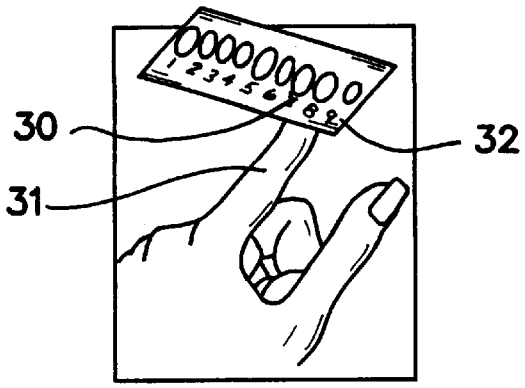
FIG. 3 is a top view of the user measuring her nails with the nail template.

Referring to FIGS. 2 and 3, the user's nail 31 is measured with a template 18. The template 18 has a plurality of openings 17 with different shapes and sizes, each of which is identified by a number 32. Preferably, the template 18 is comprised of a flexible, transparent material, such as plastic. By using this type of material, the best-fitting hole can be more accurately determined as the template can be pliably placed in line with the natural curvature of the user's nail. Further aiding in finding the appropriate size hole, the transparency of the material will enable one to see the shape and size of the hole in proportion to the nail and finger underneath. The template is not limited to a specific number of openings or hole sizes and shapes. The correct size hole 17 is selected and its corresponding number 32 on the template 18 noted.

With reference to FIG. 1, the image that is to be applied to the nail is scanned 2 using a computer scanner, preferably one having at least 300 dots per inch (DPI). This is because the resolution needs to be fine enough so that the detail will not be lost when the image is reduced to the small, fingernail size. The picture is then digitally resized 3 to the template hole size previously selected.

The new image is then printed out 4 on a computer printer. Although any type of computer printing machine may be used, one delivering at least 1200 DPI high-resolution color is preferred. This is so the quality of the Photo Nails™ end product will not be compromised. As the nail design is of such a small size (i.e. fingernail size), reducing the dots per inch will significantly impact its detail and clarity. In a preferred embodiment, the printer is a Phaser® 780 Color Plus Printer manufactured by Xerox.

The image is printed out on a transparent sheet. This sheet may be film or a like substance in which the printed image can be seen through on the reverse side. Preferably, the sheet comprises a thin, flexible transparent polymeric film, such as vinyl, mounted on a paper or similar removable backing which adds strength and body to the sheet. A preferred embodiment uses FOTOCAL FC waterslide photocopier paper, which is a film laminated waterslide decal paper. It is manufactured by Decalcomania Papers in accordance with the International Quality Standard IS09002.

Figure 4:
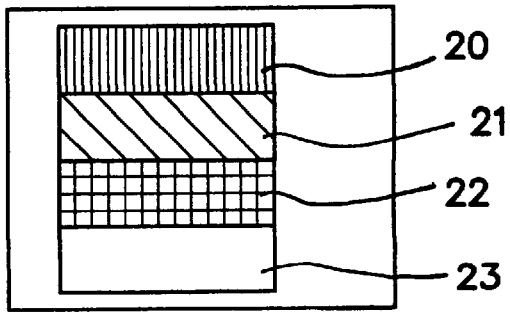
FIG. 4 is a cut-away view of the photo with two layers of protective substrates (preferably acrylic polymer emulsion varnish and white molecu bond vinyl color coat)

Referring to FIG. 4 (not drawn to scale), the printed side of the film 23 is treated with a substrate 21 that covers the ink 22, sealing and protecting the film 23. The substrate 21 also acts as the background color to the image 22. It is recommended that a white color substrate be used in order to provide an opaque backing for the picture. Though other colors can be used (or even a clear coat), it may affect the image appearance as the picture will have the hue of that particular color since the color shows through. An example of a preferred substrate is a molecu bond vinyl color coat (white) manufactured by Bryn Dana International and comprised of MEK, MIBK, ethyl acetate, dimethyl ether, and VOC with a content dose not to exceed 95% by weight. It is preferred that a second coat of the substrate 21 be applied to the same side of the film 23 (printed side) to fully protect the printed image 22 from damage in further processing.

Next, the printed side of the film 23 is treated with a coating 20 that covers the colored-backing substrate 21. This coating 20 further protects the printed image 22. A preferred coating is an acrylic polymer emulsion varnish manufactured by Liqui Tex.

Figure 5:
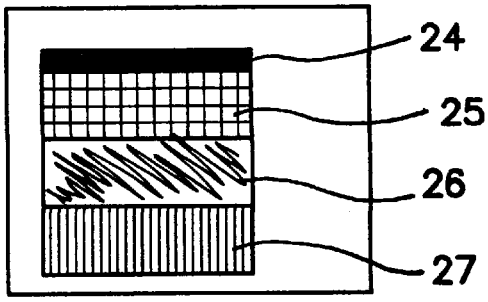
FIG. 5 is cut-away view of the film with two layers of protective substrates (preferably ultra color clear vinyl and acrylic polymer emulsion varnish)
Figure 6:
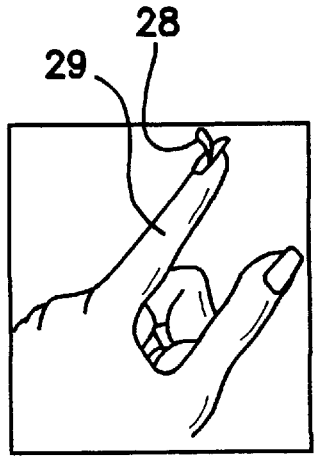
FIG. 6 is a top view of the product being applied to the fingernail.

With reference to FIG. 1, the product is submerged in water 7 until the film separates from the paper backing. The separation process takes approximately twenty seconds to complete. As shown in FIG. 5 (not drawn to scale), the film 25 is then treated on the opposite side of the image 24 with a protective covering 26. This covering 26 acts to safeguard the film 25 against wear on the user's nail. A preferred covering is ultra vinyl color clear manufactured by Plasti-Kote and comprised of acetone, ethyl ethoxy propianate, methyl ethyl ketone, toluene, xylene, and a propane-isobutane mixture. Clear nail polish should not be used as it may dissolve or otherwise impair the transparent film. To further shield and protect the image from wear, a sealant 27 is applied to that same side of the film 25 (opposite the printed image 24). A preferred sealant is acrylic polymer emulsion varnish manufactured by Liqui Tex.

Referring to FIG. 1, the image is now punched out 10 with a punch cutter to the exact template size previously selected. Although it is contemplated that any punch cutter making holes the size of those on the nail template can be used, in a preferred embodiment a punch manufactured by Pace Punches, Inc. is desired. The punch sizes for this product are as follows (in centimeters): $\frac{3}{8}\times\frac{1}{2}$, $\frac{3}{8}\times\frac{9}{16}$, $\frac{3}{8}\times\frac{3}{4}$, $\frac{7}{16}\times\frac{5}{8}$, $\frac{7}{16}\times\frac{11}{16}$, $\frac{1}{2}\times\frac{5}{8}$, $\frac{1}{2}\times\frac{3}{4}$, $\frac{9}{16}\times\frac{11}{16}$, and $\frac{9}{16}\times\frac{13}{16}$. The punched-out picture is then treated on the original (print) side with an adhesive backing 11 that will attach the film to the nail, holding it in place. In a preferred embodiment, a remount repositional adhesive manufactured by 3M Co. and comprised of isobutane, acetone, 2-methylpentane, propane, acrylate polymer, 3-methylpentane, 2-3-dimethylbutane, 2-3-dimethylbutane, and N-hexane is used.

The product is then mounted 12 on a backing sheet for storage until use. Any backing sheet allowing easy removal of the film can be used, such as waxed paper or a like material having a slick, smooth surface. When the user is ready to apply the image, the film is removed from the backing sheet 13 and the adhesive side is applied to the fingernail 14, followed by one or more coats of clear nail polish 15. The nail polish acts to further secure the image to the nail, thus allowing the image to be worn for a longer amount of time. Generally, the image can be worn on the nail for several weeks.

Figure 7:
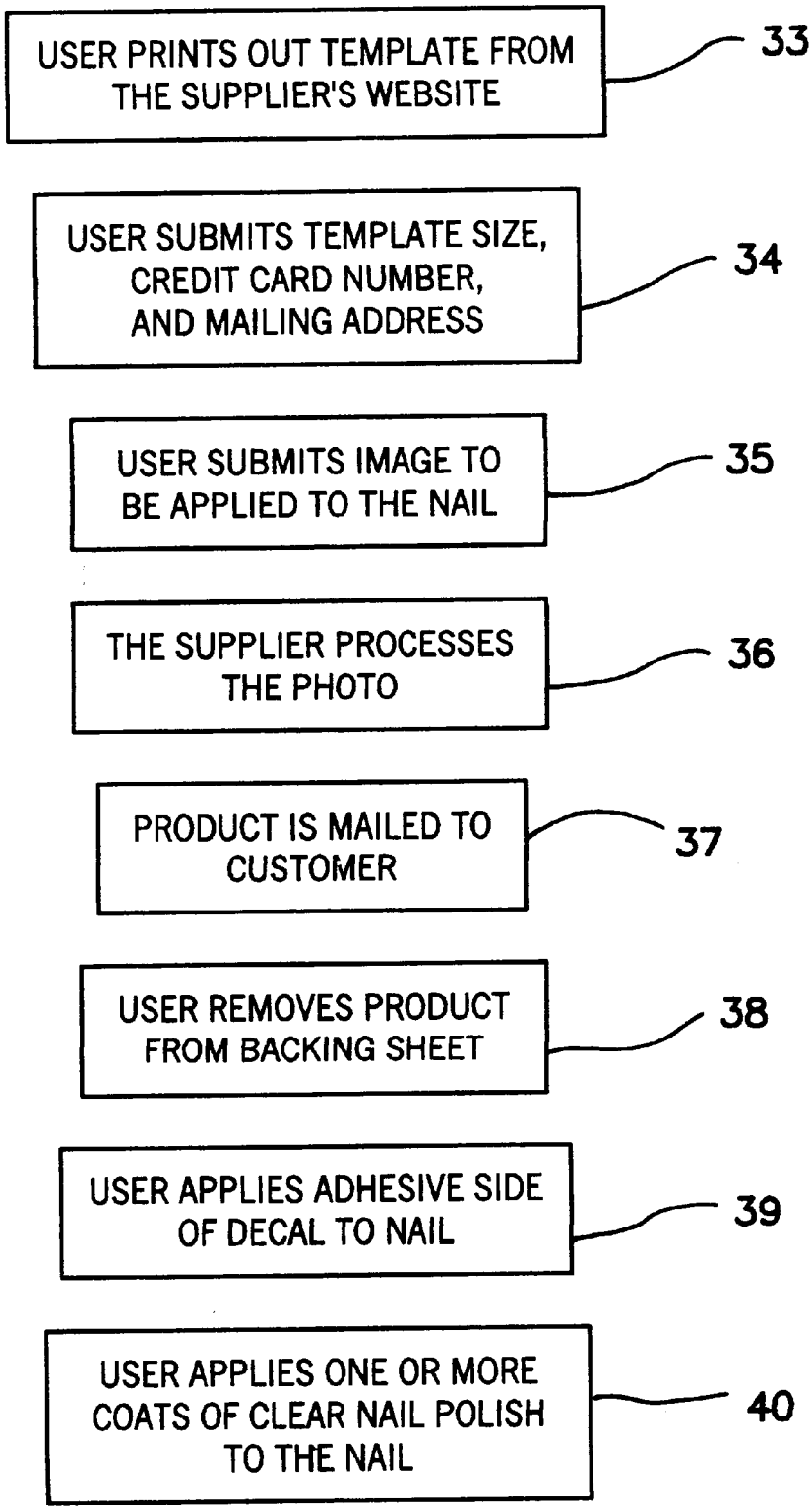
FIG. 7 is a flow diagram of the entire method of a preferred embodiment of the present invention as performed via the Internet.

This system for sizing, ordering, and preparing decorative images for fingernails can also be performed over the Internet. This enables users to apply the images to their own nails without the assistance of a manicurist. Referring to FIG. 7 there is seen a flow diagram outlining a preferred embodiment of the entire process of applying pictures to fingernails via the Internet.

The user goes online to the URL address of the supplier and, using any computer printer, prints out the nail template 33. The template can be printed out on any printing material, such as paper. The printed template is comprised of a series of different circular shapes and sizes, each identified by a number. In one embodiment, the user can hold the template directly over his or her nail to measure. In an optional embodiment, the user can cut out the holes and then measure his or her nail.

The user then submits the correct template size, referencing the corresponding number, to the supplier along with a credit card number and mailing address 34. This process can be done via e-mail, a secured submission form on the website, or a like method. The picture to be applied to the nail is also submitted to the supplier 35. In one embodiment, users can scan the image themselves using a computer scanner or digital camera and then send in a digital copy of the picture, noting the portion of the picture desired to be applied to the nail. In another embodiment, users can mail the photo to the supplier where the picture is scanned, noting the portion of the picture desired to be applied to the nail.

Next, the supplier processes the photo to create the nail design 36. This is done by the process described previously (see FIG. 1). The product is then mailed to the customer 37. When the user is ready to apply the image, the film is removed from the backing sheet 38 and the adhesive side is applied to the fingernail 39, followed by one or more coats of clear nail polish in order to further secure the image to the nail 40.

It is an advantage of the present invention that users can place decorative images on their fingernails. It is a further advantage of the present invention that the nail designs will be personalized and unique as to the individual users. Another advantage of the present invention is that it allows users to apply the designs directly to their natural nails, without the need for artificial nails. An additional advantage is that the present invention can be performed over the Internet, thereby allowing users to apply the images themselves without the assistance of a manicurist or beauty salon.

I claim:

1. A photograph printed on a polymeric film for application to a nail comprising:

a first substrate applied to an image side of said film, said first substrate being vinyl;

a second substrate applied to said first substrate;

a third substrate applied to a non-image side of said film; and a fourth substrate applied to said third substrate.

2. The photograph of claim 1 wherein said film is vinyl.

3. The photograph of claim 1 wherein said film is mounted on waterslide decal paper.

4. The photograph of claim 1 wherein said first substrate is white.

5. The photograph of claim 1 wherein said first substrate is colored.

6. The photograph of claim 1 wherein said first substrate is clear.

7. The photograph of claim 1 wherein a second layer of said first substrate is applied to said first layer.

8. The photograph of claim 7 wherein said second layer of said first substrate is vinyl.

9. The photograph of claim 7 wherein said second layer of said first substrate is white.

10. The photograph of claim 7 wherein said second layer of said first substrate is colored.

11. The photograph of claim 7 wherein said second layer of said first substrate is clear.

12. The photograph of claim 1 wherein said second substrate is varnish.

13. The photograph of claim 1 wherein said third substrate is vinyl.

14. The photograph of claim 1 wherein said third substrate is ultra vinyl color clear.

15. The photograph of claim 1 wherein said fourth substrate is acrylic polymer emulsion varnish.

16. The photograph of claim 1 wherein an adhesive is applied to said second substrate.

17. The photograph of claim 16 wherein said adhesive is a remount repositional adhesive.

18. A method of applying a photograph printed on a polymeric film to a nail comprising the steps of:

applying a first substrate to an image side of said photograph, said first substrate being vinyl;

applying a second substrate to said first substrate;

applying a third substrate to a non-image side of said photograph;

applying a fourth substrate to said third substrate;

applying an adhesive to said second substrate;

positioning said photograph on said nail; and applying at least one coat of clear nail polish to said second substrate.

19. The method of claim 18 wherein said first substrate is white.

20. The method of claim 18 wherein said first substrate is colored.

21. The method of claim 18 wherein said first substrate is clear.

22. The method of claim 18 wherein a second layer of said first substrate is applied to said first layer.

23. The method of claim 22 wherein said second layer of said first substrate is vinyl.

24. The method of claim 22 wherein said second layer of said first substrate is white.

25. The method of claim 22 wherein said second layer of said first substrate is colored.

26. The method of claim 22 wherein said second layer of said first substrate is clear.

27. The method of claim 18 wherein said photograph is mounted on waterslide decal paper.

28. The method of claim 18 wherein said second substrate is varnish.

29. The method of claim 18 wherein said third substrate is vinyl.

30. The method of claim 18 wherein said third substrate is ultra vinyl color clear.

31. The method of claim 18 wherein said fourth substrate is acrylic polymer emulsion varnish.

32. The method of claim 18 wherein an adhesive is applied to said second substrate.

33. The method of claim 32 wherein said adhesive is a remount repositional adhesive.

* * * * *